US005380009A

United States Patent [19]

Henry et al.

[11] Patent Number: 5,380,009

[45] Date of Patent: Jan. 10, 1995

[54] NOTCHED GOLF CLUB FACE

[75] Inventors: Randy D. Henry; Ross D. Henry, both of Hayden, Id.

[73] Assignee: Henry-Griffitts, Inc., Hayden, Id.

[21] Appl. No.: 220,365

[22] Filed: Mar. 30, 1994

[51] Int. Cl.[6] ..... A63B 53/04

[52] U.S. Cl. ..... 273/167 A; 273/167 H; 273/167 E; 273/167 J

[58] Field of Search ..... 273/80.1, 80.2, 193 R, 273/194 R, 77 R, 167 A, 167 E, 169, 167 F, 167 J, 174, 172, 167 H

[56] References Cited

U.S. PATENT DOCUMENTS

| | | | |
|---|---|---|---|
| 626,347 | 6/1899 | Smith . | |
| 1,437,463 | 12/1922 | Boye . | |
| 2,550,846 | 5/1951 | Milligan . | |
| 3,166,320 | 1/1965 | Onions . | |
| 3,333,854 | 8/1967 | White . | |
| 3,625,517 | 12/1971 | Durnack | 273/167 F |
| 3,869,126 | 3/1975 | Thompson . | |
| 3,893,672 | 7/1975 | Schonher | 273/167 J |
| 3,997,170 | 12/1976 | Goldberg . | |
| 4,312,509 | 1/1982 | Grant | 273/167 A |
| 4,417,731 | 11/1983 | Yamada | 273/167 H |
| 4,484,746 | 11/1984 | Brill | 273/167 A |
| 4,508,350 | 4/1985 | Duclos | 273/169 |
| 4,754,977 | 7/1988 | Sahm | 273/171 |
| 4,838,555 | 6/1989 | Kobayashi . | |
| 4,877,249 | 10/1989 | Thompson . | |
| 5,042,806 | 8/1991 | Helmstetter . | |
| 5,060,949 | 10/1991 | Brill . | |
| 5,060,951 | 10/1991 | Allen . | |

FOREIGN PATENT DOCUMENTS

| | | | |
|---|---|---|---|
| 340579 | 1/1931 | United Kingdom . | |
| 377463 | 7/1932 | United Kingdom | 273/167 A |

OTHER PUBLICATIONS

The Dorset Corporation Advertisement, "Comes the Revolution: dorset 2," The Sporting Goods Dealer, Apr. 1975.

*Primary Examiner*—Sebastiano Passaniti
*Attorney, Agent, or Firm*—Wells, St. John, Roberts, Gregory & Matkin

[57] ABSTRACT

A golf club head using a hollow structural shell is provided with a continuous transverse notch formed by a recessed wall extending transversely across the lower edge of the club face. The recessed wall joins the sole surface of the club head behind the club face. It reduces the upright span of the club face without modifying its overall height.

10 Claims, 5 Drawing Sheets

NOTCHED GOLF CLUB FACE

TECHNICAL FIELD

This disclosure pertains to golf clubs, and specifically to a metal "wood" having a strengthened club face.

BACKGROUND OF THE INVENTION

A conventional set of golf clubs includes a series of woods used for shots from a tee or fairway, a series of irons used for shorter shots, and a putter used on the green. Traditional woods have heads made of a hardwood, such as persimmon. However, in recent years real wood has been substantially replaced by metal heads comprising a hollow cast shell filled with a synthetic plastic foam. For purposes of this disclosure, the resulting club shall be termed a metal "wood."

A recent development in metal "woods" has been the production and use of larger sized metal "wood" club heads. Enlargement of the club face area on such a club results in enlargement of the "sweetspot" area. This is the area wherein the center of gravity of the club head is directly behind the point at which a golf ball is being struck by the club.

While it is not practical to produce oversize club heads from natural wood, due to their solid construction and resulting increases in weight as a function of size, the hollow nature of metal "wood" clubs provides the club designer with an opportunity to substantially vary the size and configuration of such club heads. Metal "woods" are today manufactured and sold in a normal size generally corresponding to the size of a natural wood club head, a midsize having a slightly increased club face area, and in oversize or jumbo sizes that are very distinctly larger than a conventional club head. A significant design limitation of such larger club heads is that maintaining normal ranges of club head weight seriously restricts the thicknesses of the walls about the hollow shell forming such heads.

When designing hollow metal club heads of increased size, the average thickness of the larger surface areas encountered about a club head must be correspondingly decreased. This has resulted in weakening and collapse of club faces due to the failure of the unsupported span of metal across the club face, which often is incapable of withstanding the impact of a golf ball being struck by the club head. Many such clubs have failed because the weakened club face structure cannot withstand the maximum impact forces to which they can be subjected during normal play.

One response to the structural limitations of metal "wood" club faces in larger sized club heads has been to provide integral bracing at the rear surface of the club face. This can take the form of vertical and/or horizontal ribs, as well as enclosed cells that strengthen the club face area and structurally resist ball impact forces. However, there are limits to the amount of integral bracing that can be provided at the club face without either increasing the weight of the club head beyond permissible design limits or substantially sacrificing thickness in other areas of the hollow club head shell.

This invention was developed in an effort to structurally strengthen the club face of a metal "wood" having a larger sized club head without sacrificing the desired increased area and height of the club face available for striking a golf ball. In addition, the improvement described below slightly lowers the sweetspot on an enlarged club face. The result of this improvement is a structurally strengthened club face without diverting substantial mass and weight to internal bracing at the back of the club face.

BRIEF DESCRIPTION OF THE DRAWINGS

Preferred embodiments of the invention are described below with reference to the accompanying drawings, which are briefly described below.

FIG. 8 is an enlarged cross-sectional view as seen along line 8—8 in FIG. 2.

DETAILED DESCRIPTION OF THE PREFERRED EMBODIMENTS

Figure 1:
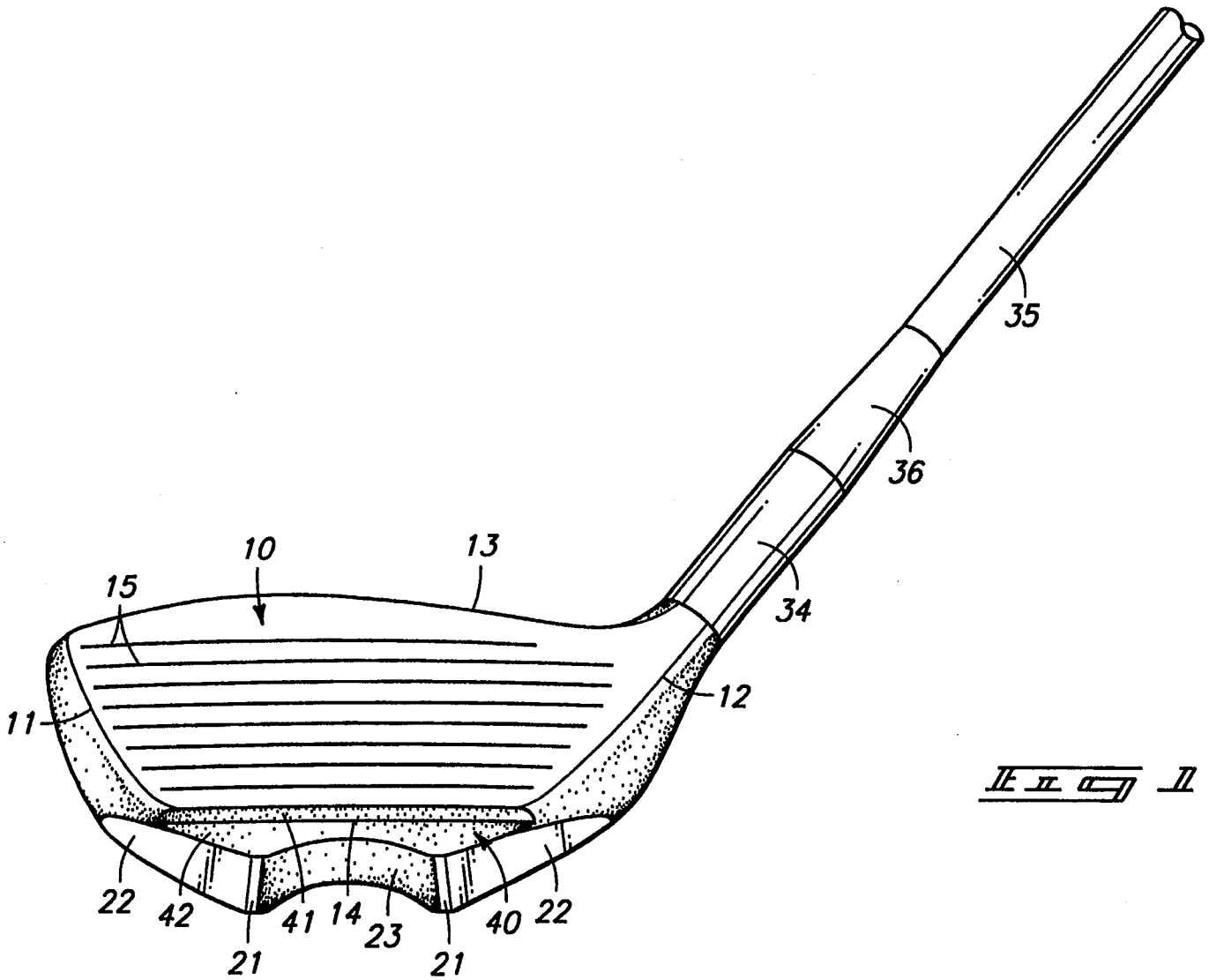
FIG. 1 is a front perspective view of a metal "wood," the upper portions of the handle being broken away.

This disclosure of the invention is submitted in furtherance of the constitutional purposes of the U.S. Patent Laws "to promote the progress of science and useful arts" (Article 1, Section 8).

This invention pertains specifically to the design of larger sized metal "wood" club heads, but is not limited to any particular club size or type, nor is it limited to club head shells contructed of any particular material. The disclosed shell structure can be applied to both normal or oversized club heads. It can be applied to hollow club head shells made from stainless steel or other metals, as well as structural plastics, ceramics and other suitable materials.

The club head illustrated in the drawing was designed and constructed as part of a midsize metal "wood". The maximum height of the club face is approximately 42 mm. The diagonal width of the club face area, from one corner to another, is approximately 75 mm. These dimensions are merely exemplary and it is to be understood that the improvements described below can be incorporated within club heads having both larger and smaller corresponding dimensions about the club face area.

The illustrated club head is constructed as a hollow structural shell of metal or other suitable material. It is typically cast in two parts—an upper hollow body including the club face and a separate bottom plate. These two parts are conventionally welded to one another to produce an integral hollow shell that can subsequently be filled with plastic foam. The production steps required to cast, fill and finish metal "wood" club heads are well known. They need not be further detailed in order to provide an understanding of the present improvement.

The illustrated club face 10 extends between transversely spaced side edges 11 and 12. The club face 10 has an upright span extending between an upper edge 13 and a lower edge 14. While a golf ball might be engaged anywhere about the club face 10, it is preferably struck within an elliptical "sweetspot," where the center of gravity of the club head is substantially aligned behind the point of impact. Increasing the club face area on larger sized club heads results in corresponding enlargement of the "sweetspot". This improves the likelihood of gaining greater ball distance by shots that are properly executed by use of the enlarged club head in the game of golf.

Figure 2:
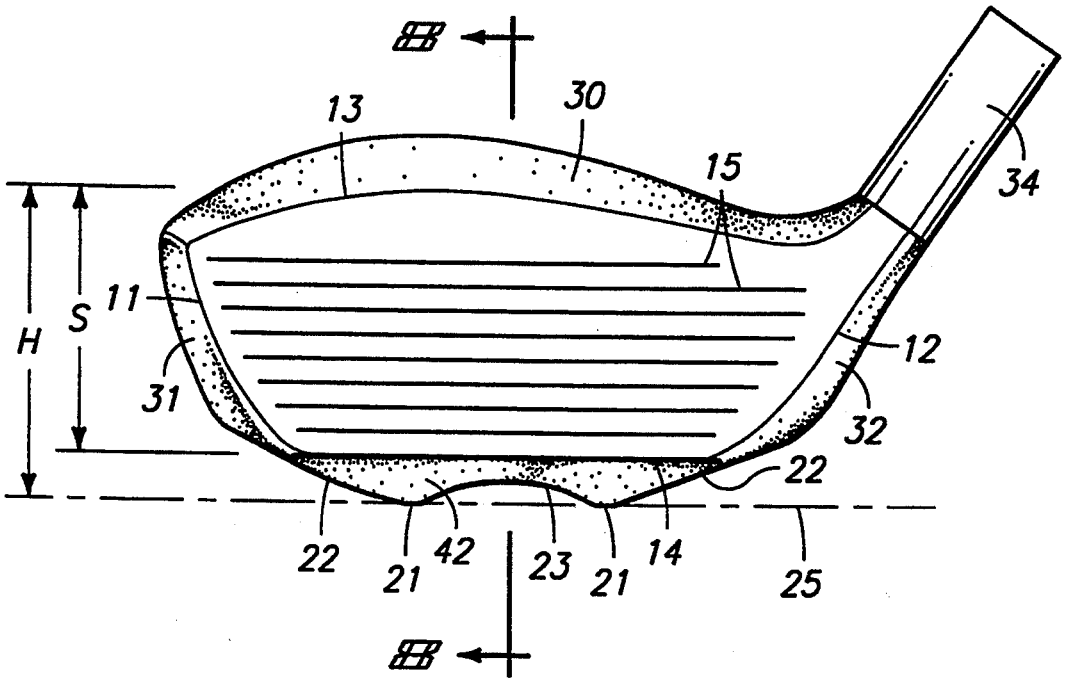
FIG. 2 is a front view of the club head.
Figure 3:
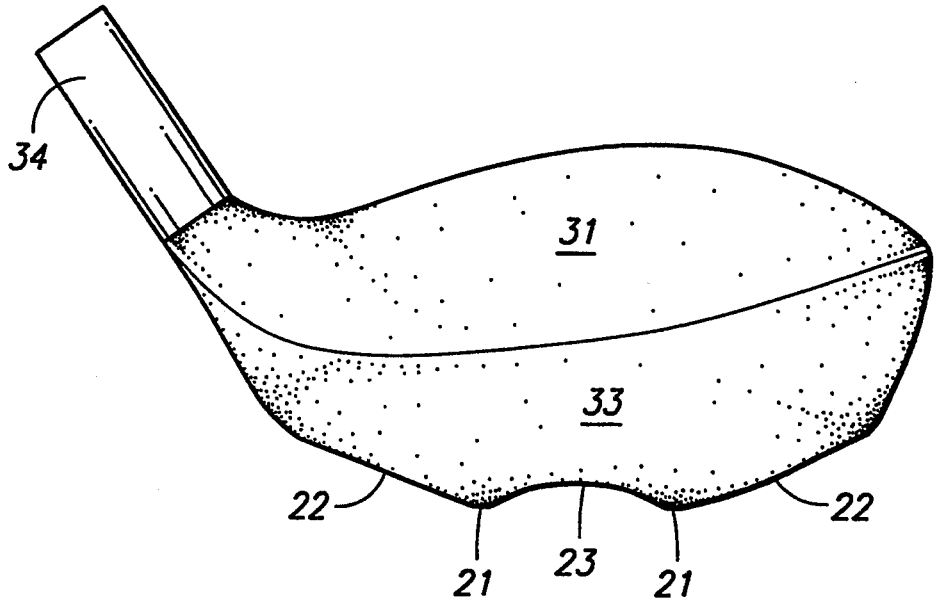
FIG. 3 is a rear view.
Figure 4:
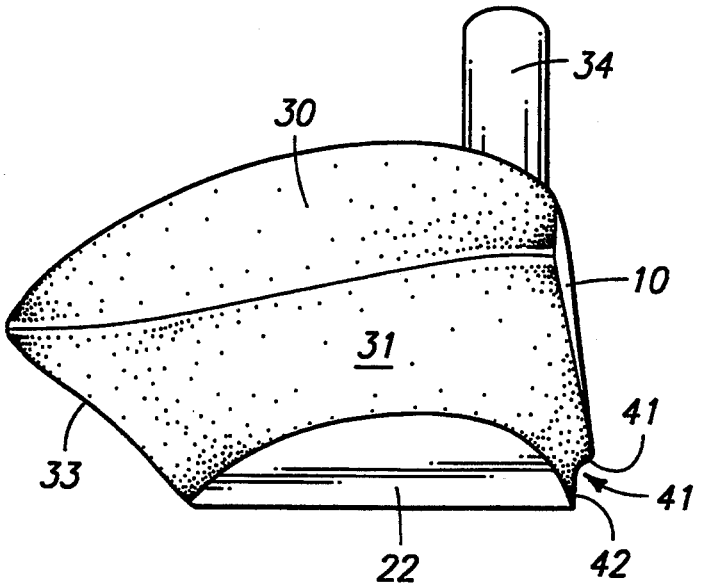
FIG. 4 is an outer side elevation.
Figure 5:
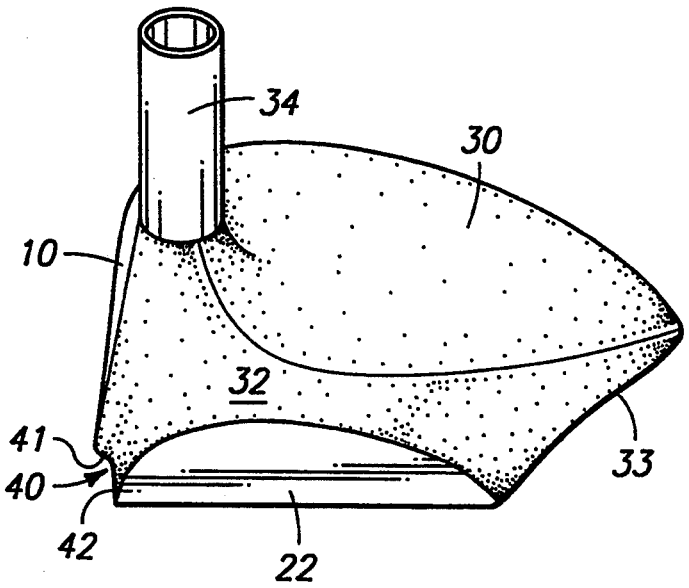
FIG. 5 is an inner side elevation.
Figure 6:
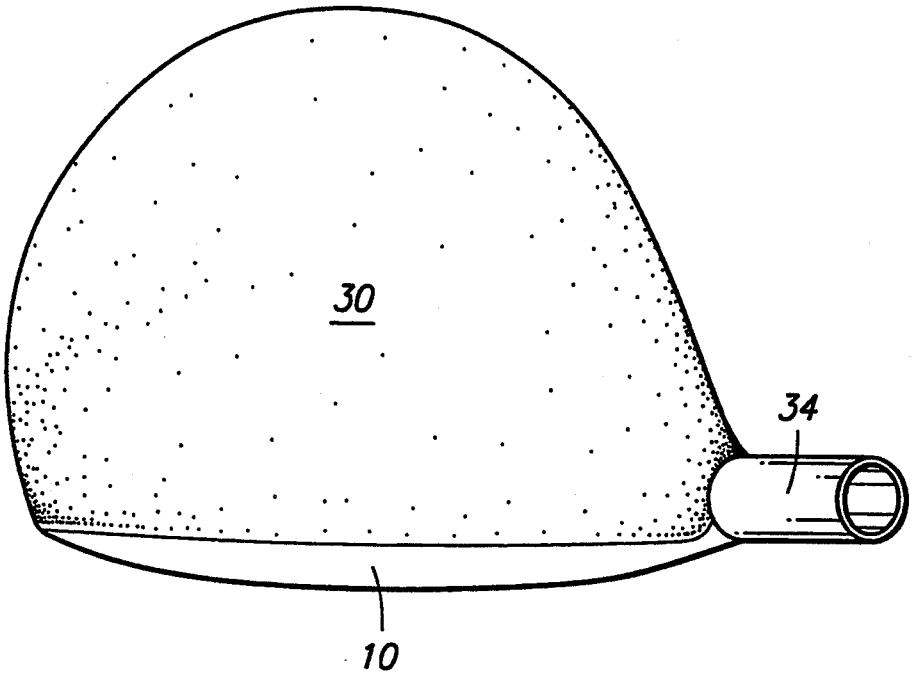
FIG. 6 is a top view.
Figure 7:
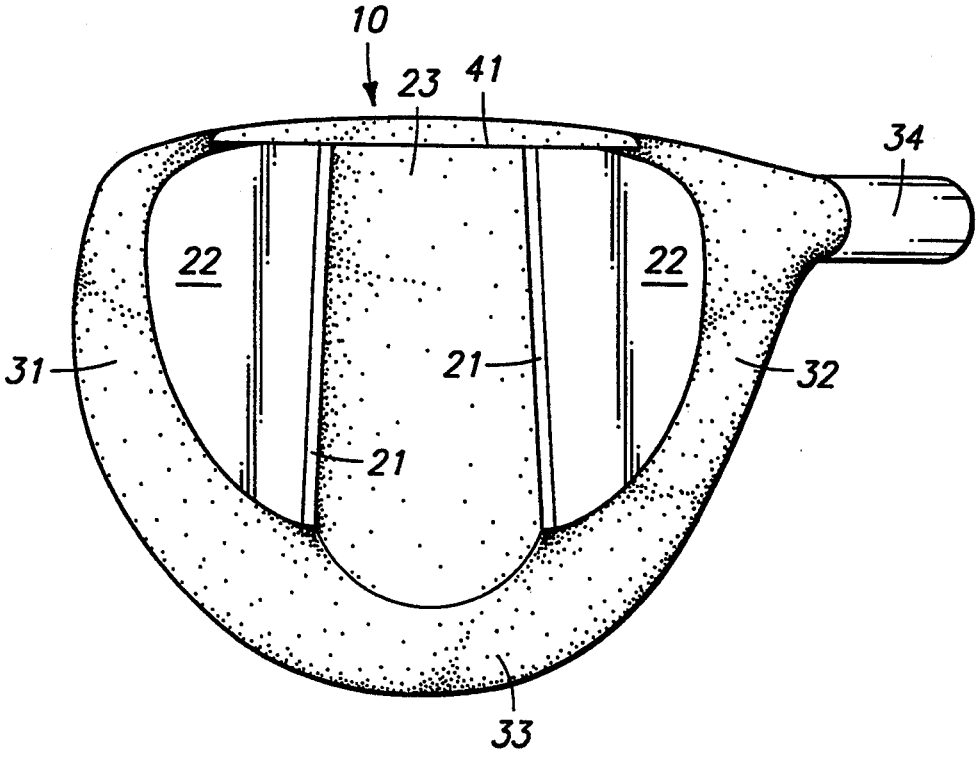
FIG. 7 is a bottom view.
Figure 11:
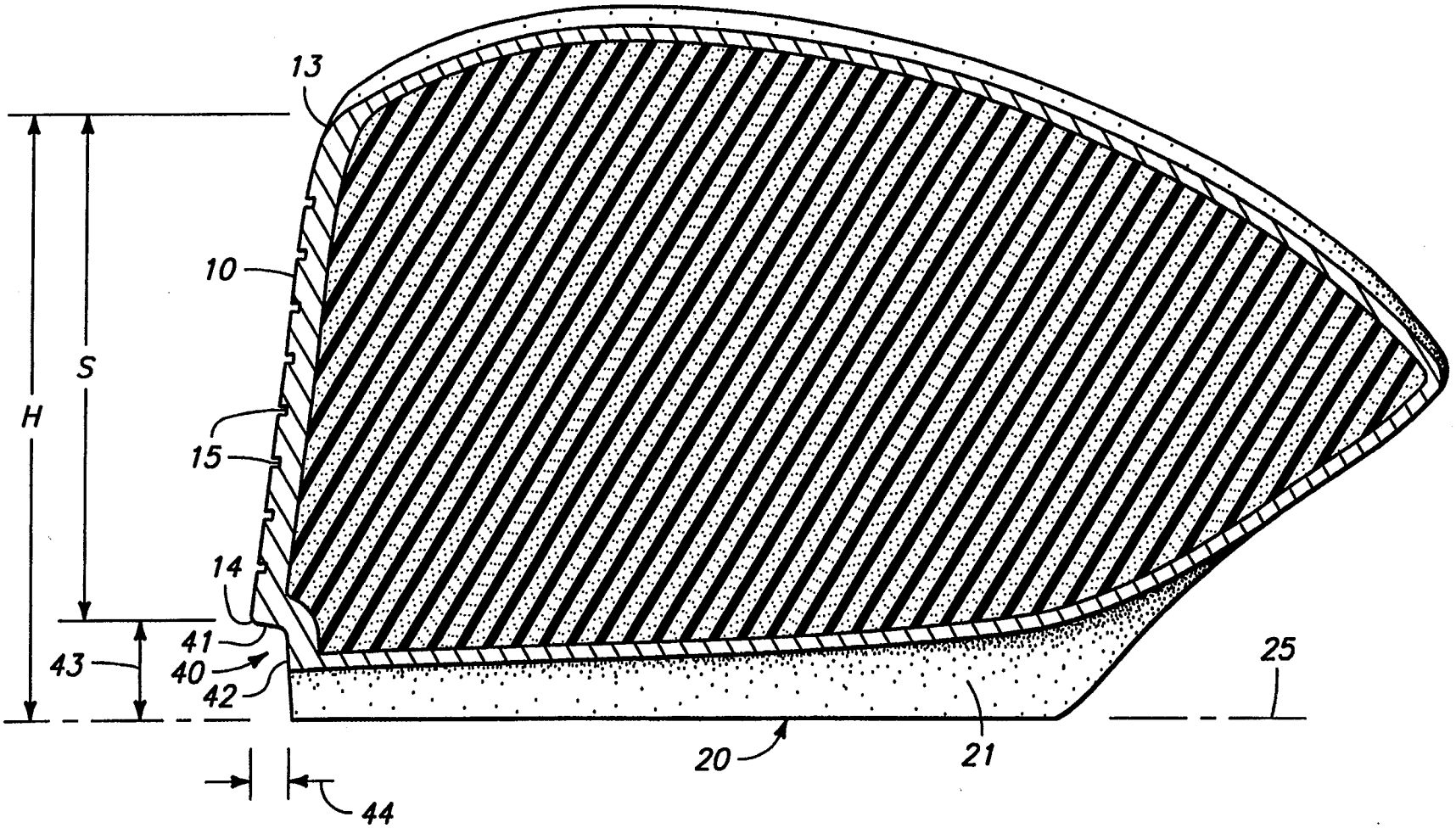

The exterior of club face 10, which might have any desired loft, is provided with a series of parallel transverse grooves 15 in a conventional pattern. The upright span "S" of the club face 10 is illustrated in both FIGS. 2 and 8. The indicated span constitutes the maximum vertical distance across the club face surface between upper and lower edges 13 and 14.

The bottom plate of the hollow shell presents a sole surface 20 for guiding the club head through a lie as a golf ball is being struck. The sole surface might be planar or formed in any other desirable configuration. It should be designed to maximize the guiding efficiency of the sole and to minimize any resulting drag on the club head as turf and other surface materials are engaged by it.

In the illustrated example, the sole surface includes a recessed tunnel 23 extending the length of the surface 20 between dual runners 21 merging into oppositely inclined side sole faces 22. The dual runners 21 define a club head support plane (indicated at 25) from which the height "H" of club face 10 is measured (see FIGS. 2 and 8).

It is to be noted that the club face span "S" is a fraction of the club face height "H". The overall height of the club face is truncated at the bottom of the club face 10 by a vertical distance substantially less than the radius of a golf ball. Thus, the enlarged "sweetspot" area provided by vertical enlargement of the club head is not reduced in size, since it does not extend vertically downward into the recessed area.

The club head is completed by a conventional convexly curved upper surface 30, an outer curved toe surface 31, an inner curved heel surface 32, and a back surface 33 that joins the surfaces 31 and 32 across the rear of the club head. An upwardly protruding hollow neck 34 is formed integrally with the shell of the club head and provides an opening through which foam material can be directed into it during production.

A conventional shaft 35 is fixed to the club head at neck 34. The illustrated connection of shaft 35 and club head might include a conventional hosel 36 or whipping (not shown).

The present improvement is presented by a continuous recessed wall at the lower edge of the club face 10. The exterior surface of the recessed wall is in the form of a forwardly-facing transverse notch 40. Notch 40 extends transversely across the lower edge 14 of the club face 10 and through both of the toe and heel surfaces 31, 32.

The recessed wall is joined across the sole surface 20 at a location behind the club face 10. It therefore terminates and reduces the upright span "S" of the club face 10 without modifying the overall height "H" of the club face 10.

The illustrative details of the recessed wall can best be understood from the sectional view shown in FIG. 8. The recessed wall includes an upper section 41 leading rearwardly from the club face 10. It intersects an upright section 42 leading upwardly from the sole surface 20.

The recessed depth of the upper section 41 is constant across the full width of the club head between the toe and heel surfaces 31, 32. This dimension is indicated in FIG. 8 by arrows 44. In addition, the vertical height of the upright section 42 between the support plane 25 of the sole surface 20 and the upper section 41 is constant across the full width of the club head between the toe and heel surfaces 31, 32. This dimension is illustrated in FIG. 8 by arrows 43.

As can be seen in FIG. 8, it is conventional to form club face 10 with a material thickness greater than the thicknesses of the remaining club head elements. However, experience has shown that a continuous club face area over the full club face height "H", if designed within normal weight limitations, will not be capable of resisting collapse in response to the impact of golf balls under expected playing conditions.

The provision of the recessed wall that forms notch 40 across the bottom of club face 10 shortens the upright span "S" that is substantially unsupported along the height "H" of the club face 10. The dimensions of the remaining area of the club face 10 in a midsized club head more closely resemble the dimensions about the club face area of a normal club head. The club face can therefore be effectively designed and produced in a thickness having sufficient strength to prevent collapse under foreseeable game conditions while meeting specified weight limits for the club head.

To assure adequate strength across the bottom of the club face 10, it is preferable that the thickness of the shell across the recessed wall be substantially identical to its thickness across the club face 10. In the club head size previously described, the thickness dimension about the club face 10 is approximately 2.5 mm. This thickness dimension is maintained across the upper section 41 and upright section 42 of the recessed wall forming the transverse notch 40 as illustrated. The thicknesses of the remaining club head elements will be less than this dimension, and can be proportioned in the conventional manner to withstand foreseeable forces to which these elements might be subjected.

The illustrated upper section 41 across notch 40 is located in a plane parallel to and spaced above the support plane 25 of the sole surface 20. The upper section preferably leads rearwardly at a right angle from the club face 10. Conversely, the upright section leads upwardly from the support plane 25 of the sole surface 20 and intersects the inwardly recessed terminus of upper section 41. The upright section leads rearwardly at a right angle from the support plane 25.

The perpendicular interconnections of sections 41 and 42 with the club face 10 and sole surface 20 provide maximum reinforcing strength to the resulting structural interruption presented across the bottom of the club face. This angular relationship, plus the continued maximum thickness about the front of the club head substantially stiffens the remaining area of club face 10 to resist its collapse upon impact with a golf ball.

While not illustrated, it is to be understood that light ribs or other bracing can be formed about the back surface of club face 10 in the conventional manner.

The above-described modification of the club head substantially stiffens the club face 10 without sacrificing sweetspot area. In addition, the increased mass available toward the bottom of the club face 10 slightly lowers the sweetspot on the club face, which has been shown to improve hitting distance in many user applications. Actual tests of a midsize club head constructed according to this invention have shown average distance improvements of approximately 10 yards in comparison to identical club heads having no notch 40 across the bottom of their club faces.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A golf club head in the form of a hollow structural shell, the exterior of the shell comprising:

a club face extending between transversely spaced side edges and having an upright span extending between upper and lower edges;

a sole surface for guiding the club head through a lie as a golf ball is being struck by the club face, the sole surface presenting a supporting plane from which the height of the club face is measured;

an upper surface extending rearwardly from the upper edge of the club face;

outer and inner upright toe and heel surfaces extending rearwardly from the respective side edges of the club face and joining a back surface; and a continuous recessed wall having an exterior surface in the form of a forwardly-facing transverse notch extending transversely across the lower edge of the club face and through both of the toe and heel surfaces, the recessed wall being joined across the sole surface behind the club face to thereby reduce the upright span of the club face without modifying its overall height;

the thickness dimensions of the shell across the club face and across the recessed wall being greater than the thickness dimensions of the remaining club head elements.

2. The golf club head of claim 1, wherein the shell is metal, and further comprising:

a club shaft secured to a neck protruding integrally from the shell;

the resulting club being a metal "wood".

3. The golf club head of claim 1, wherein the thickness dimensions of the shell across the club face and across the recessed wall are substantially identical.

4. The golf club head of claim 1, wherein the exterior surface of the recessed wall includes an upper section leading rearwardly from the club face and intersecting an upright section leading upwardly from the sole surface.

5. The golf club head of claim 1, wherein the exterior surface of the recessed wall includes an upper section leading rearwardly from the club face and intersecting an upright section leading upwardly from the sole surface, the recessed depth of the upper section between the club face and the upright section being constant across the full width of the club head between the toe and heel surfaces.

6. The golf club head of claim 1, wherein the exterior surface of the recessed wall includes an upper section leading rearwardly from the club face and intersecting an upright section leading upwardly from the sole surface, the height of the upright section between the support plane of the sole surface and the upper section being constant across the full width of the club head between the toe and heel surfaces.

7. The golf club head of claim 1, wherein the exterior surface of the recessed wall includes an upper section leading rearwardly from the club face in a plane parallel to and spaced above the support plane of the sole surface, the upper section intersecting an upright section leading upwardly from the sole surface.

8. The golf club head of claim 1, wherein the exterior surface of the recessed wall includes an upper section leading rearwardly at a right angle from the club face.

9. The golf club head of claim 1, wherein the exterior surface of the recessed wall includes an upright section leading upwardly at a right angle from the support plane of the sole surface.

10. The golf club head of claim 1, wherein the exterior surface of the recessed wall includes an upper section leading rearwardly at a right angle from the club face and intersecting an upright section leading upwardly at a right angle from the support plane of the sole surface.

* * * * *